US007134871B2

(12) United States Patent
Chen et al.

(10) Patent No.: US 7,134,871 B2
(45) Date of Patent: Nov. 14, 2006

(54) TIMER DEVICE FOR GAS STOVE FOR ALLOWING GAS-TURNING OFF AUTOMATICALLY

(76) Inventors: Chun-Chia Chen, No. 378, Jiu Guang Rd., Yuan Lin Zhen, Jang Hua Hsien (TW); Tai-An Chen, No. 378, Jiu Guang Rd., Yuan Lin Zhen, Jang Hua Hsien (TW)

( * ) Notice: Subject to any disclaimer, the term of this patent is extended or adjusted under 35 U.S.C. 154(b) by 497 days.

(21) Appl. No.: 10/665,640
(22) Filed: Sep. 19, 2003

(65) Prior Publication Data

US 2005/0063132 A1 Mar. 24, 2005

(51) Int. Cl.
*F23N 5/00* (2006.01)
*F23N 3/00* (2006.01)

(52) U.S. Cl. ..... 431/86; 126/285.5

(58) Field of Classification Search ..... 431/86; 126/285.5; 110/192
See application file for complete search history.

(56) References Cited

U.S. PATENT DOCUMENTS 5,094,259 A * 3/1992 Hsu ..... 137/66

* cited by examiner

*Primary Examiner*—Alfred Basichas
(74) *Attorney, Agent, or Firm*—Charles E. Baxley

(57) ABSTRACT

A timer device for gas stove for allowing gas turning-off automatically, which comprising a housing, a disc-like wheel, a motor, a driving wheel, an microswitch and a timing circuit, wherein the housing mounted on a surface of a gas stove, an top surface and a bottom of the housing respectively defined with an upper and a lower round holes for the passage of a rotary-knob switch, about the periphery of the upper round hole formed with a plurality of locating holes for the insertion of locating wheels, the locating wheels being "V"-shaped in its cross section for supporting the disc-like wheel, the disc-like wheel mounted under the upper round hole, at the center of the which an oblong aperture is formed and at the periphery of the bottom of the wheel provided with teeth for engaging with the driving wheel of the motor, a protrusion upstanding from the disc-like wheel; the motor disposed in the housing, with the cooperation of the prior mentioned elements, when the gas is being used, a normal contacting pole is switched on to turn on the timing circuit and make it start to count time, when the set time is reached and if the gas is not turned off, the motor will drive the disc-like wheel to return to its original position so as to turn off the gas and meanwhile to cut off the power.

5 Claims, 3 Drawing Sheets

TIMER DEVICE FOR GAS STOVE FOR ALLOWING GAS-TURNING OFF AUTOMATICALLY

BACKGROUND OF THE INVENTION

1. Field of the Invention

The present invention relates to a timer device, and more particularly to a timer device which is applied to gas stove for automatically turning off the gas.

2. Description of the Prior Arts

For the reason of public safety about gas using, it is very important for housewives to use gas for cooking in the kitchen security. Under this consideration it is necessary for us to invent some new device to control the processing and avoiding any kind of danger when gas is used deleted somewhat damage in case of fire.

The timer device is invented for controlling the gas of gas stove which is mounted on the gas stove and passage through the rotary-knob switch of stove for automatically turning off the gas in time.

SUMMARY OF THE INVENTION

The primary object of the present invention is to provide a timer device, which is applied to gas stove for automatically turning off the gas.

A timer device for gas stove for turning-off the gas automatically, which comprising a housing, a disc-like wheel, a motor, a driving wheel, a microswitch and a timing circuit, wherein the housing mounted on a surface of a gas stove, an top surface and a bottom of the housing respectively defined with an upper and a lower round holes for the passage of a rotary-knob switch, about the periphery of the upper round hole formed with a plurality of locating holes for the insertion of locating wheels, the locating wheels being "V"-shaped in its cross section for supporting the disc-like wheel, the disc-like wheel mounted under the upper round hole, at the center of the disc-like wheel an oblong aperture is formed and at the periphery of the bottom of the same provided with teeth for engaging with the driving wheel of the motor, a protrusion upstanding from the disc-like wheel; the motor disposed in the housing, which can be actuated by signals emitted from the timing circuit, the microswitch is a three pole switch having a leaf spring employed to be contacted by the upstanding protrusion of the disc-like wheel. With the cooperation of the prior mentioned elements, when the gas is used, the protrusion disengages from the leaf spring of the microswitch, and the normal contacting pole is switched on to turn on the timing circuit and starts to count time, as the time set is reading and the user forget to turned off the gas, the motor will be actuated to drive the disc-like wheel to return to its original position so as to make the rotary-knob switch turn the gas off, at the same time, the protrusion will touch the leaf spring of the microswitch to cut off the timer system power; when the gas is turned off, the protrusion keeps touching the leaf spring of the microswitch, the normal contacting pole is disconnected from power.

The present invention will become more obvious from the following description when taken in connection with the accompanying drawings, which shows, for purpose of illustrations only, the preferred embodiment in accordance with the present invention.

DETAILED DESCRIPTION OF THE PREFERRED EMBODIMENTS

Figure 1:
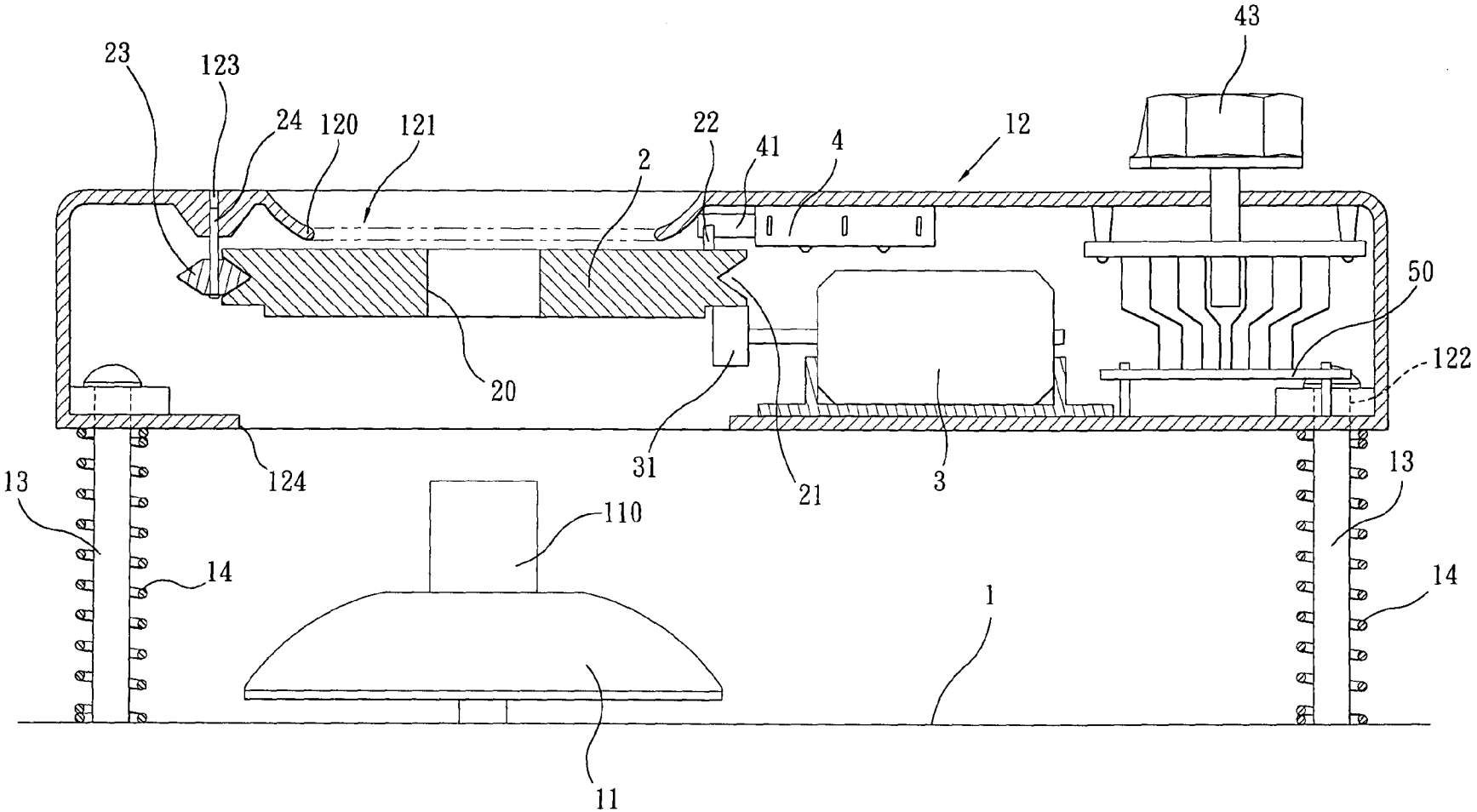
FIG. 1 is a cross sectional view of a timer device of the present invention.
Figure 2:
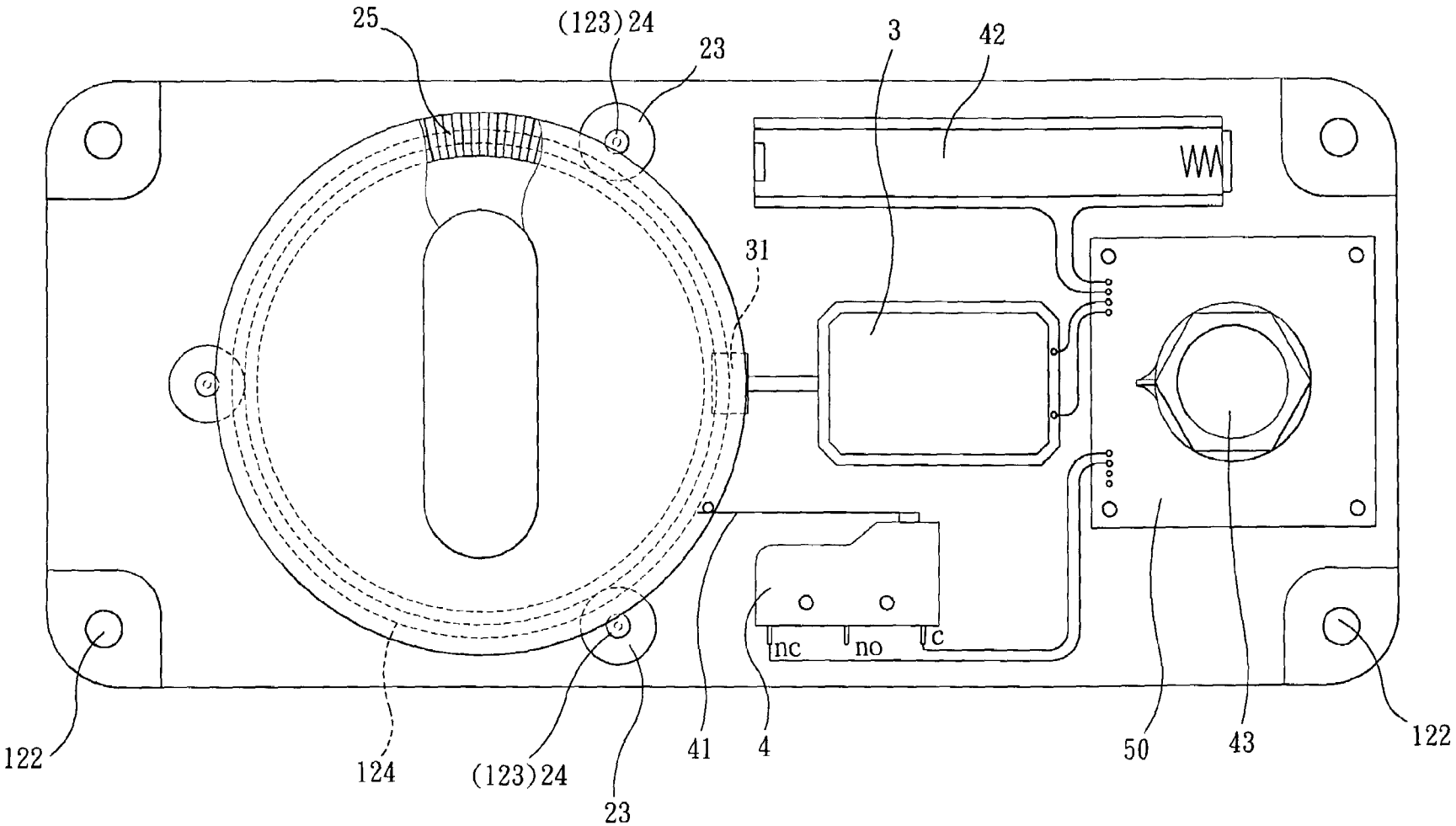
FIG. 2 is a top view of a housing of the timer device of the present invention.
Figure 3:
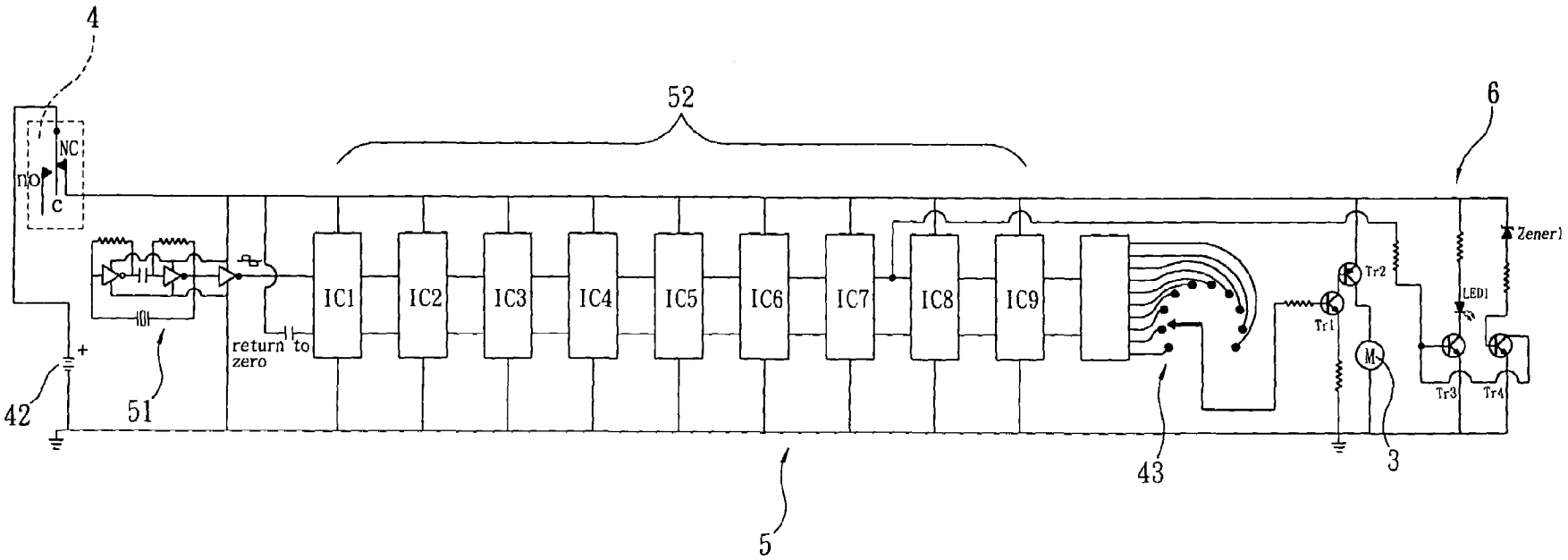
FIG. 3 is a circuit diagram of the timer device of the present invention.

Referring to FIGS. 1 and 3, wherein a timer device for gas stove for allowing automatic gas turning-off in accordance with the present invention is shown and generally comprising: a housing 12, a disc-like wheel 2, a motor 3, a driving wheel 31, a microswitch 4 and a timing circuit 5. The hardware of the timing circuit 5 includes a battery unit 42, a circuit board 50 and the micro switch 4. With reference to FIGS. 1, 2, wherein the housing 12 is a cuboid, on a bottom of which is defined with four bolt holes 122, and thus screw bolts 13 can be screwed on the surface of a gas stove 1 by passing through the respective bolt holes 122. The screw bolts 13 also could be adjusted on the surface of the gas stove 1 by passing through springs 14 first in order to improve the fixing effect. For practical purposes, the bolt holes 122 are defined on reinforcing plates so as to improve the strength of the hole surface. At a certain position of the top surface and bottom of the housing 12 an upper and a lower round holes 120, 124 are formed respectively for the passage of a rotary-knob switch 11. About the periphery of the upper round hole 120 is provided with a negative-arc surface 121 for improving operation. Furthermore, a plurality of locating holes 123 are formed at the adjacent portion to the periphery of the negative-arc surface 121 for the insertion of minor axes 24 of locating wheels 23. The locating wheels 23 are "V"-shaped for supporting the disc-like wheel 2. The disc-like wheel 2 is a disc member circularly defined with a V-shaped slot 21, at the center of the disc-like wheel 2 an oblong aperture 20 is formed and at the periphery of the bottom of the same is provided with teeth 25 for engaging with that of the driving wheel 31, a protrusion 22 upstanding from the disc-like wheel 2 serves to contact a leaf spring 41 of the microswitch 4. The aperture 20 is provided for the insertion of a long knob 110. The disc-like wheel 2 is disposed under the upper round hole 120, the locating wheels 23 engage with the V-shaped groove 21 for supporting the disc-like wheel 2. When the long knob 110 of the rotary-knob switch 11 is rotated to turn on/off the gas, the protrusion 22 on the disc-like wheel 2 will follow to rotate. In case that the gas is not being used (is turned off), the protrusion 22 will keep touching the leaf spring 41 of the microswitch 4. Thereby, through the protrusion 22 touching/disengaging from the leaf spring 41 of the microswitch 4, the timing circuit 5 can be controlled.

Referring to FIGS. 1 and 2, wherein the motor 3 is mounted in the housing 12 with its driving wheel 31 engaged with the teeth 25 on the outer periphery of the bottom of the disc-like wheel 2. The motor 3, actuated by the timing circuit 5, which serves to effect the rotation of the driving wheel 31 for enabling the disc-like wheel 2 to return to its original position, so as to make the rotary-knob switch 11 turn off the gas. The disc-like wheel 2 is mounted onto the rotary-knob switch 11 and rotates along with the rotation of the rotary-knob switch 11 and which also can be pulled back to its original position by the motor 3. The battery unit 42 is disposed in the housing 12 and serves as a power supply both for the motor 3 and the timing circuit 5. The microswitch 4 is a three pole switch, the normal close pole of which is (NC) and the normal open pole is (NO), when the gas is not being used, the protrusion 22 keeps touching the leaf spring 41 of the microswitch 4, the normal close pole (NC) is not switched on, but the normal open pole (NO) is switched on. When the gas is being used, the protrusion 22 disengages from the leaf spring 41 of the microswitch 4, in this case, the normal close pole (NC) is switched on to turn on the timing circuit 5 and make it start to count time. When the time set by the time-setting knob 43 is reached and if the gas is not turned off, the motor 3 will be actuated to drive the disc-like wheel 2 to return to its original position so as to make the rotary-knob switch 11 turn the gas off. At the same time, the protrusion 22 will touch the leaf spring 41 of the microswitch 4 for cutting off the power both of the timing circuit 5 and the motor 3.

Referring to FIG. 3, wherein the timing circuit 5 generally includes a quartz oscillating circuit 51, a counting circuit 52 and the time-setting knob 43. After the quartz oscillating circuit 51 is turned on, quartz crystal of which will output fixed frequency and transmit it to the counting circuit 52 which having multi-stage dividers (IC1–IC9), and the signal is transacted by the counting circuit 52 so as to enable the signals to be transmitted with ten minutes as a time unit, and then the time-setting knob 43 is able to set the timer for 10, 20 . . . 100 minutes. With the cooperation of the prior mentioned elements, if the user chooses the stage No. 6, that means the timer is set at 60 minutes. And then the user turns on the gas and ignite it, that is turning the rotary-knob switch 11 and the disc-like wheel 2 follows to rotate, in this case, the protrusion 22 disengages from the leaf spring 41 of the microswitch 4, the normal close pole (NC) is switched on to turn on the timing circuit 5, that means the quartz oscillating circuit 51, the counting circuit 52 and the time-setting knob 43 start to work for 60 minutes. If the user turns off the gas before the set time expires, the disc-like wheel 2 will follow to rotate so as to make the protrusion 22 touch the leaf spring 41 of the microswitch 4, that is switching off the normal close pole (NC), turning off the timing circuit 5 and cutting off the power of the motor 3. And thus makes the timing circuit 5 return back to its original state. If within the set time limit, 60 minutes is reached but the user forgets to turn off the gas, positive electricity will be transmitted instantly to the motor 3 for driving the disc-like wheel 2 to return back to its original position, and thus makes the rotary-knob switch 11 return to turn off the gas, at the same time, the protrusion 22 will touch the leaf spring 41 of the microswitch 4, such that disconnect the timing circuit 5 and the motor 3 from power.

Referring further to FIG. 3, in which, the timer device can be additionally provided with a battery-detecting circuit 6. During the operation of the gas range, the timing circuit 5 is switched on, viz. the common pole (C) is connected with the normal close pole (NC), at this moment, the Zener diode (Z) can detect if the voltage of the battery is enough or not. If the voltage of the battery is within safe range, the Zener diode (Z) will be turned on, and then the electrical crystal (Tr4) is turned on too, at this moment, the electrical crystal (Tr3) is turned off. Thereby, warning light (LED) will not be lighted on in case of shortage of battery power. Vice versa, the Zener diode (Z) will be turned off in case of shortage of the battery power, the electrical crystal (Tr4) will be turned off, a base electrode of the electrical crystal (Tr3) serves to receive the signals emitting from a timer (IC7), the timer (IC7) which counting time with second as a time unit will emit signals repeatedly. Since the timer (IC7) emits signals once per second, and thus the warning light (LED) will flash periodically so as to inform the user to replace the battery unit 42.

While we have shown and described various embodiments in accordance with the present invention, it should be clear to those skilled in the art that further embodiments may be made without departing from the scope of the present invention.

What is claimed is:

1. A timer device for a gas stove comprising a housing, a disc-like wheel, a motor, a driving wheel, a microswitch and a timing circuit; wherein:

the housing is mounted on a surface of the gas stove, an upper and a lower round holes are formed in an top surface and a bottom surface of the housing, respectively, for the passage of a rotary-knob switch, a plurality of locating holes is formed around the upper round hole for the insertion of locating wheels, each of the locating wheels is V-shaped in cross section for supporting the disc-like wheel, the disc-like wheel is mounted under the upper round hole, an oblong aperture is formed in the center of the disc-like wheel and a plurality of teeth is formed on a periphery of a bottom of the disc-like wheel for engaging with the driving wheel of the motor, a protrusion protrudes vertically from the disc-like wheel, the motor is disposed in the housing and is to be actuated by signals emitted from the timing circuit, the microswitch is a three-pole switch having a leaf spring employed to be contacted by the protrusion of the disc-like wheel, when the gas stove is turned on, the protrusion disengages from the leaf spring of the microswitch, and a normal close pole is switched on to turn on the timing circuit and make it start to count time, when the set time is reached and if the gas is not turned off, the motor will be actuated to drive the disc-like wheel to its original position, and the rotary-knob switch will turn the gas off, at the same time, the protrusion will touch the leaf spring of the microswitch to cut off the power, when the gas is turned off, the protrusion keeps touching the leaf spring of the microswitch, the normal close pole is disconnected from power.

2. The timer device for gas stove as claimed in claim 1, wherein the disc-like wheel rotates along with a rotation of the rotary-know switch, so as to achieve an automatic timing effect.

3. The timer device for gas stove as claimed in claim 1, wherein a V-shaped groove is formed around an outer periphery of the disc-like wheel, and the oblong aperture formed in the center of the disc-like wheel is used to drive the rotary-knob switch.

4. The timer device for gas stove as claimed in claim 1, wherein the timing circuit includes a quartz oscillating circuit, a counting circuit and a time-setting knob, the counting circuit has a multi-staged divider, which enables signals to be transmitted by using ten minutes as a time unit, the timing-setting knob provides ten stages for timing.

5. The timer device for gas stove as claimed in claim 1, wherein the timing circuit is provided with a battery-detecting circuit having a Zener diode for detecting whether battery power is enough, when the battery power is low, the Zener diode is turned off, an electrical crystal (Tr4) is turned off, and a base electrode (Tr3) receives the signals emitting from a timer (IC7), the timer (IC7) counting time by using second as a time unit will emit signals repeatedly, since the timer (IC7) emits signals once per second, a warning light (LED) flashes periodically so as to inform the user to replace the battery unit.

* * * * *